US006244883B1

(12) United States Patent
Ito et al.

(10) Patent No.: US 6,244,883 B1
(45) Date of Patent: Jun. 12, 2001

(54) ELECTRICAL CONNECTOR ASSEMBLY PROVIDING FLOATING MOVEMENT BETWEEN CONNECTORS

(75) Inventors: Naotoshi Ito, Tokyo; Shigetoshi Yamaguchi, Kanagawa, both of (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/420,883

(22) Filed: Oct. 19, 1999

(30) Foreign Application Priority Data

Oct. 30, 1998 (JP) ..... 10-325885

(51) Int. Cl.[7] ..... H01R 13/64
(52) U.S. Cl. ..... 439/247; 439/660
(58) Field of Search ..... 439/660, 74, 247, 439/248, 246

(56) References Cited

U.S. PATENT DOCUMENTS 5,192,232 * 3/1993 Lenz et al. ..... 439/660
5,679,010 * 10/1997 Hotea et al. ..... 439/81

* cited by examiner

*Primary Examiner*—Gary F. Paumen
*Assistant Examiner*—Phuongchi Nguyen
(74) *Attorney, Agent, or Firm*—Stephen Z. Weiss

(57) ABSTRACT

An electrical connector assembly includes a plug connector having a plug portion received by a receptacle portion of a receptacle connector. The receptacle portion is larger than the plug portion to provide for floating movement between the connectors in "x" and "y" directions transverse to the mating direction of the connectors. Oblique terminal portions on one of the connectors create force vectors opposite the mating direction to provide floating movement between the connectors in the mating direction automatically in response to mating of the connectors.

5 Claims, 5 Drawing Sheets

ELECTRICAL CONNECTOR ASSEMBLY PROVIDING FLOATING MOVEMENT BETWEEN CONNECTORS

FIELD OF THE INVENTION

This invention generally relates to the art of electrical connectors and, particularly, to an electrical connector assembly which provides for floating movement between a pair of mating connectors, such as connectors which are mounted to printed circuit boards or other substrates.

BACKGROUND OF THE INVENTION

There are a wide variety of electrical connector assemblies which include male and female or plug and receptacle connectors which are designed to be mated in confronting relation. The connectors are movably mated together and, when mated, the connectors are rigidly coupled and cannot move relative to each other. Therefore, any vibrations or extraneous impacts applied to one of the connectors is transmitted to the other connector.

There are various applications wherein rigidly coupled connectors are undesirable and create problems. In other words, it is highly undesirable for vibrations or impacts to be transmitted from one connector to the mated connector. This is particularly true when the connectors are mounted to various other electronic components such as circuit boards or other substrates.

For instance, in a portable telephone assembly, the telephone may be coupled to an associated battery through a pair of mating connectors, and the telephone and battery, in turn, may be mounted to a pair of circuit boards or substrates. If the telephone is inadvertently dropped and strikes the floor or ground, the impact may cause a malfunction or damage to electronic components mounted on the circuit boards on which the mating connectors are fixed. Therefore, it is desirable to provide some form of relative floating movement between the mating connectors, and this has become increasingly difficult with the increase in miniaturization or down-sizing of such electronic devices. The present invention is directed to solving these problems in a new construction of a pair of mating connectors having floating movement therebetween.

SUMMARY OF THE INVENTION

An object, therefore, of the invention is to provide a new and improved electrical connector assembly which provides for floating movement between a pair of mated connectors.

In the exemplary embodiment of the invention, the assembly is a board-to-board electrical connector assembly. A plug connector is adapted for mounting on a first circuit board and includes a dielectric housing have a mating plug portion. A plurality of conductive terminals are mounted on the housing and have flexible contact portions located at the mating plug portion. A receptacle connector is adapted for mounting on a second circuit board and includes a dielectric housing having a mating receptacle portion for receiving the plug portion of the plug connector in a mating direction. A plurality of conductive terminals are mounted on the housing and have contact portions located in the receptacle portion for engaging the flexible contact portions of the terminals of the plug connector.

The invention contemplates that the receptacle portion of the receptacle connector be larger than the plug portion of the plug connector in "x" and "y" directions transverse to the mating direction. This provides for floating movement between the connectors and, thereby, the circuit boards in the "x" and "y" directions. In addition, an open end of the receptacle portion is spaced from an abutment wall of the housing of the plug portion when the connectors are in mated positions. This provides floating movement between the connectors and, thereby, the circuit boards in the mating or "z" direction.

As disclosed herein, at least one of the terminals of the plug connector includes a cantilevered spring beam extending generally in the mating direction of the plug connector toward the receptacle connector. A contact beam extends obliquely from a distal end of the cantilevered spring beam back over the spring beam. The contact beam extends at an angle to the mating direction such that a force vector from the contact beam against a terminal of the receptacle connector opposite the mating direction automatically causes the open end of the receptacle portion to be spaced from the abutment wall of the plug connector to allow for floating movement therebetween.

Other objects, features and advantages ofthe invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
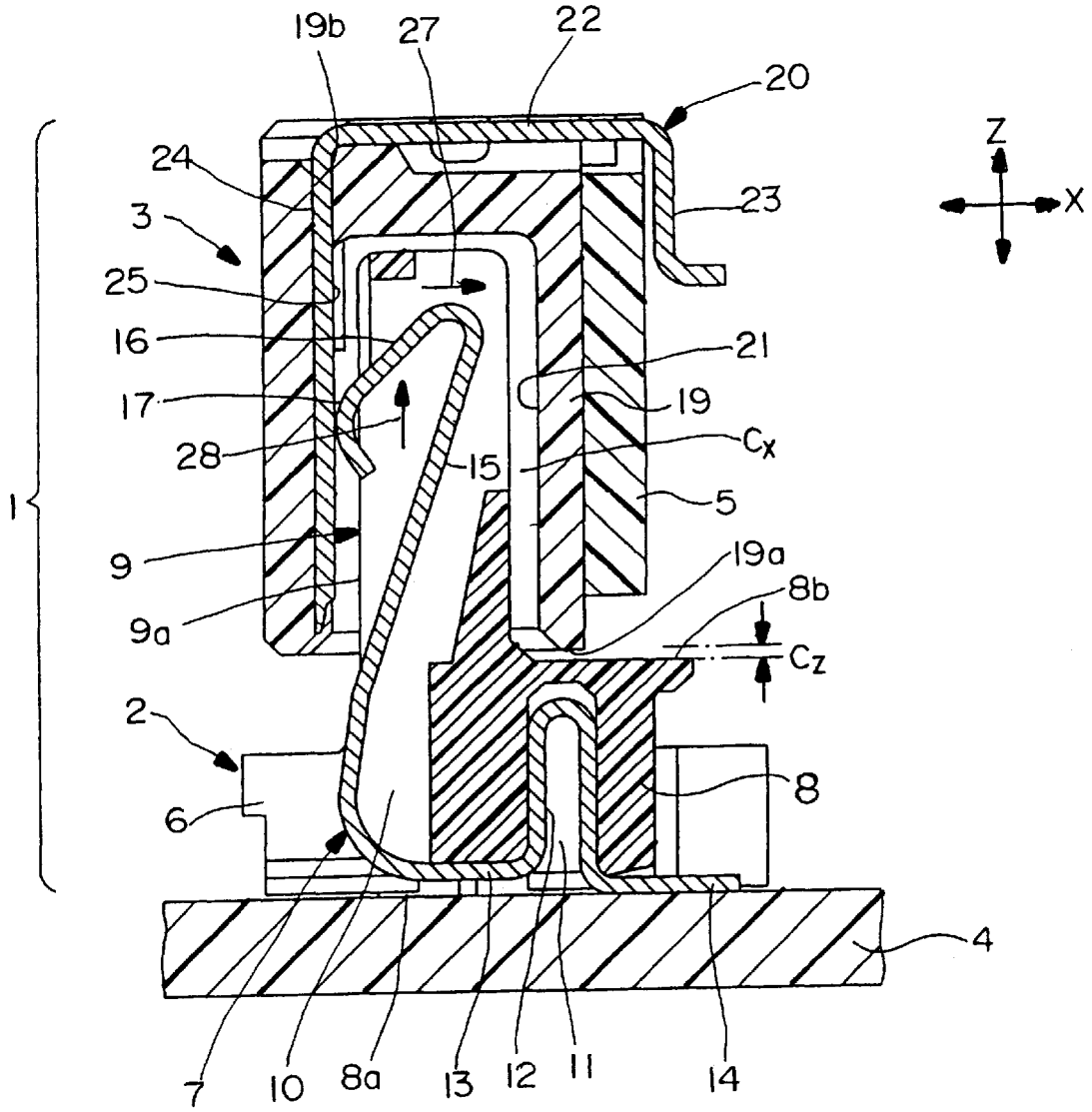
FIG. 1 is an enlarged vertical section through the connector assembly of the invention.
Figure 2:
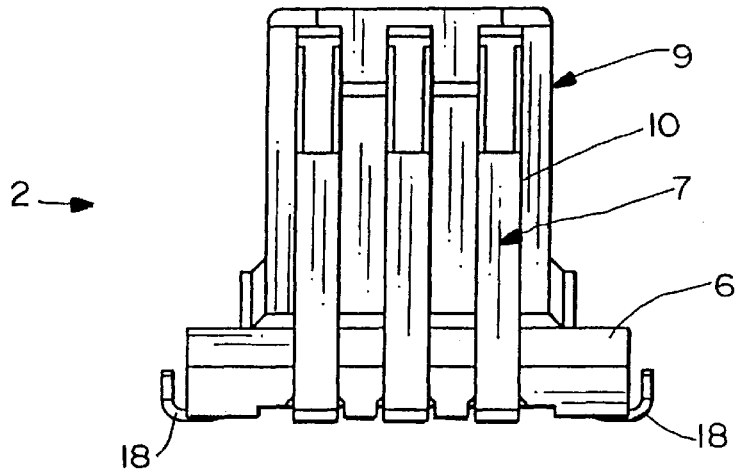
FIG. 2 is a front elevational view of the plug connector.
Figure 3:
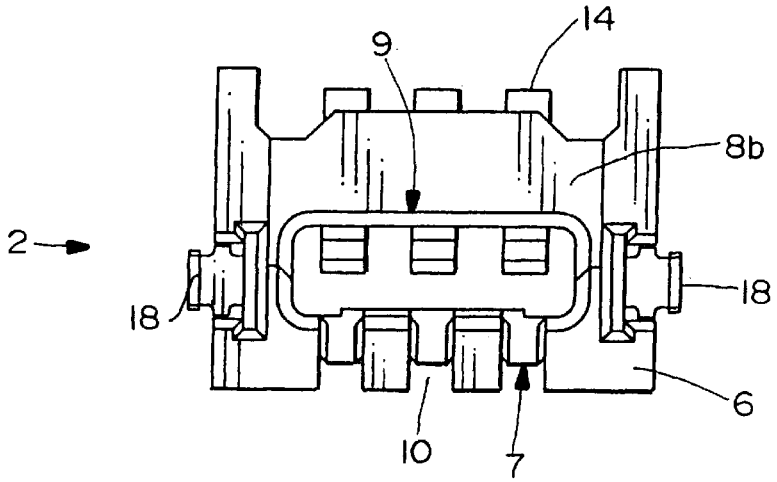
FIG. 3 is a top plan view of the plug connector.
Figure 4:
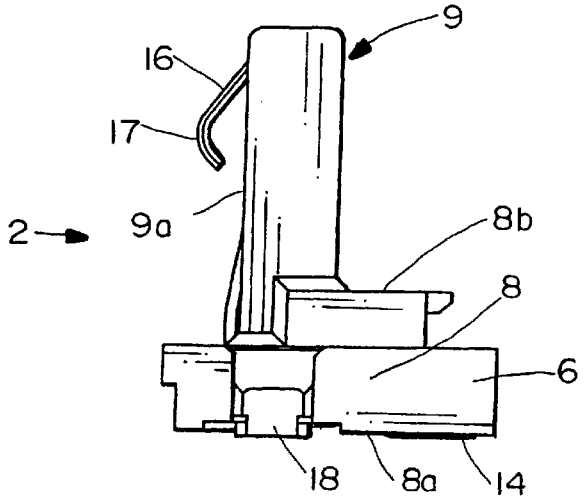
FIG. 4 is a side elevational view of the plug connector.
Figure 5:
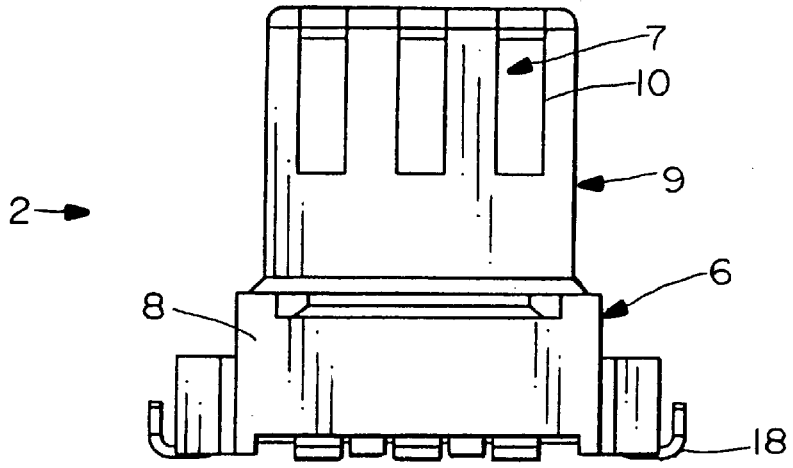
FIG. 5 is a rear elevational view of the plug connector.
Figure 6:
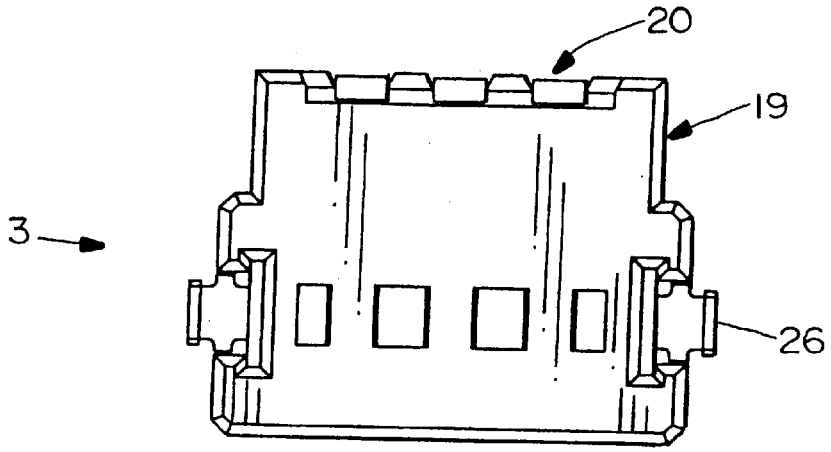
FIG. 6 is a front elevational view of the receptacle connector.
Figure 7:
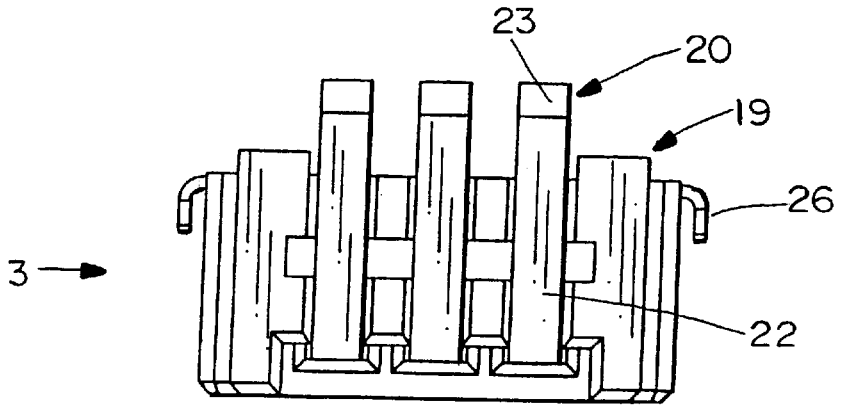
FIG. 7 is a top plan view of the receptacle connector.
Figure 8:
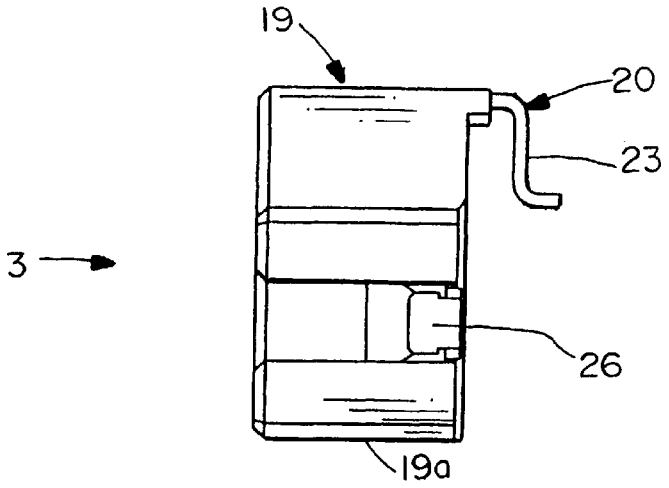
FIG. 8 is a side elevational view of the receptacle connector.
Figure 9:
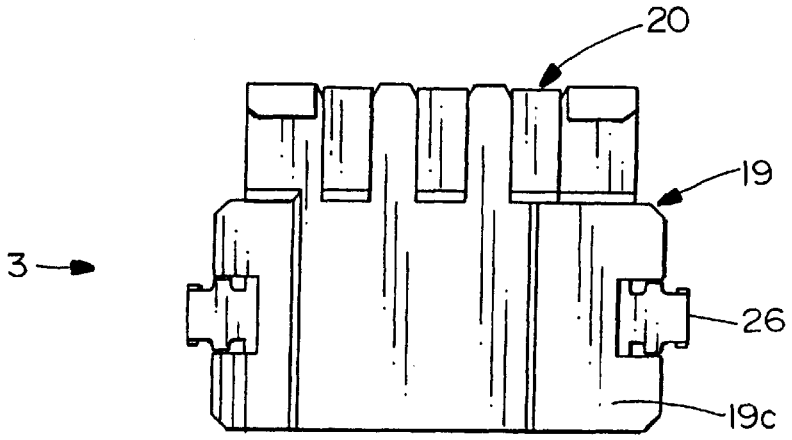
FIG. 9 is a rear elevational view of the receptacle connector.
Figure 10:
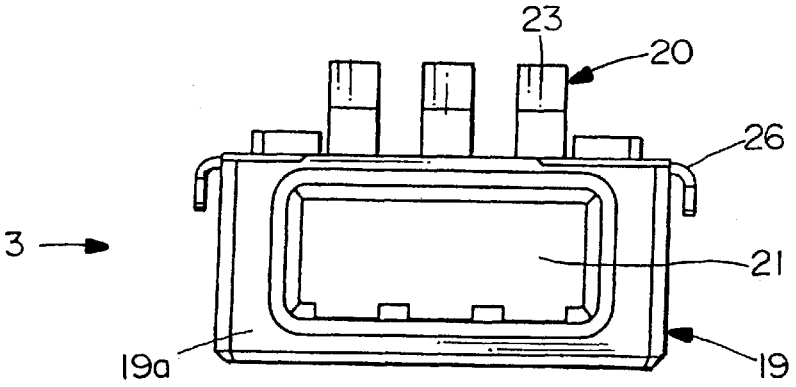
FIG. 10 is a bottom plan view of the receptacle connector.

Referring to the drawings in greater detail, FIG. 1 shows a board-to-board electrical connector assembly 1 which includes a plug connector, generally designated 2, and a receptacle connector, generally designated 3. The plug connector is adapted for mounting on a first circuit board 4 and is shown in greater detail in FIGS. 2–5. The receptacle connector is adapted for mounting on a second circuit board 5 and is shown in greater detail in FIGS. 6–10. The circuit boards are disposed in two planes perpendicular to each other, with the connectors making required electrical connections therebetween.

Referring to FIGS. 2–5 in conjunction with FIG. 1, plug connector 2 includes a dielectric housing, generally designated 6, mounting three terminals, generally designated 7. The housing may be a one-piece structure unitarily molded of dielectric material such as plastic or the like. The housing includes a terminal retaining portion 8 and a mating plug portion 9. The plug portion has terminal-receiving slots 10, and the retaining portion has terminal mounting recesses 11 which open at a bottom face 8*a* of the housing. Terminal retaining portion 8 defines a top abutment wall 8*b*. Plug portion 9 has a front wall 9*a*.

Each terminal 7 of plug connector 2 includes an inverted U-shaped engagement portion 12 which is inserted into a respective one of the bottom-opening recesses 11 in housing 6 by a press-fit to retain the terminal on the housing. Each terminal includes a base portion 13 and a solder tail 14 which extend in opposite directions from the distal ends of the legs which define U-shaped engagement portion 12. The solder tails of the terminals are connected, as by soldering, to appropriate circuit traces on circuit board 4. Each terminal includes a cantilevered spring beam 15 which extends upwardly and obliquely from base 13 into the respective terminal slot 10 in plug portion 9. A contact beam 16 extends obliquely from a distal end of spring beam 15 back over the spring beam. Contact beam 16 terminates in a rounded contact point 17.

A pair of "fitting nails" 18 are fixed to housing 6 of plug connector 2 generally flush with solder tails 14 of terminals 7. These fitting nails are fabricated of metal material and are soldered to appropriate mounting pads on circuit board 4 when solder tails 14 are soldered to circuit traces on the board, to assist in fixing the plug connector to the board.

Referring to FIGS. 6–10 in conjunction with FIG. 1, receptacle connector 3 includes a dielectric housing 19 which is a one-piece structure unitarily molded of plastic material or the like. The housing mounts three terminals, generally designated 20. The housing defines a receptacle portion 21 for receiving plug portion 9 of plug connector 2 in a mating direction which can be called the "z" direction. In essence, housing 19 has a bottom surface 19*a* which defines an open end for receptacle portion 21. The receptacle portion has a front wall 21*a*.

Each terminal 20 of receptacle connector 3 includes a base portion 22 which is disposed on top of housing 19. An L-shaped solder tail 23 extends downwardly from one end of base portion 22 for solder connector to an appropriate solder trace on circuit board 5. A contact beam 24 extends downwardly from the opposite end of base portion 22 through an opening 19*b* in housing 19 and into the open receptacle portion 21 of the housing. Each contact beam 24 has a contact surface 25 for engaging contact point 17 of a respective one of the terminals 7 of plug connector 2.

A pair of "fitting nails" 26 also are mounted on housing 19 of receptacle connector 3. These fitting nails are fabricated of metal material and are located at a rear side 19*c* of the housing for soldering to appropriate mounting pads on circuit board 5 when solder tails 23 of terminals 20 are soldered to the circuit traces on the board.

Figure 11:
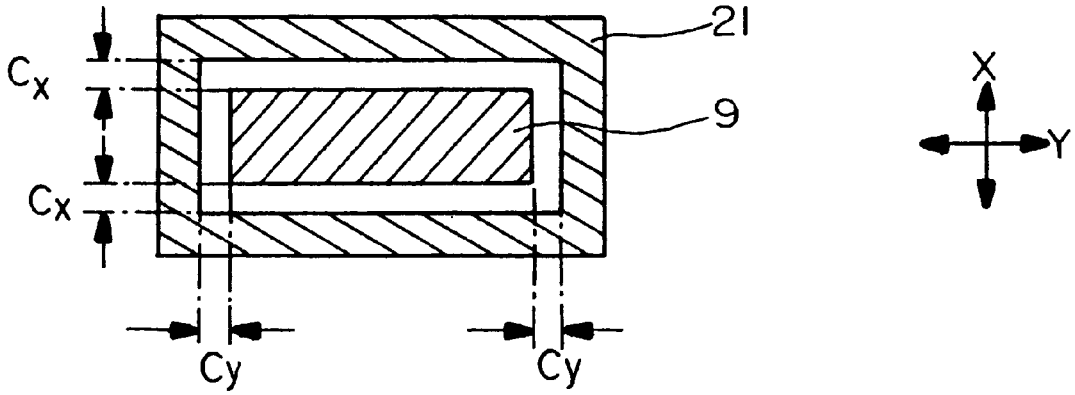
FIG. 11 is a section through the plug portion of the plug connector and the receptacle portion of the receptacle connector when the connectors are mated to show the amount of floating movement between the connectors in the "x" and "y" directions.

Referring to FIG. 11 in conjunction with FIG. 1, the invention contemplates that receptacle portion 21 of receptacle connector 3 be larger than plug portion 9 of plug connector 2 in "x" and "y" directions which are transverse to the mating direction of the connectors. The clearances between the larger receptacle portion and the smaller plug portion in the "x" and "y" directions are indicated by the double-headed arrowed spaces $C_x$ and $C_y$ in FIG. 11. Actually, spring beams 15 and contact beams 16 of terminals 7 of plug connector 2 will bias plug portion 9 to one side of receptacle portion 21 when the connectors are mated. However, FIG. 11 clearly shows the dimensional clearances between the plug portion and the receptacle portion which allows for floating movement between the connectors and, thereby, between circuit boards 4 and 5 in the "x" and "y" directions generally transverse to the mating direction of the terminals.

Figure 12:
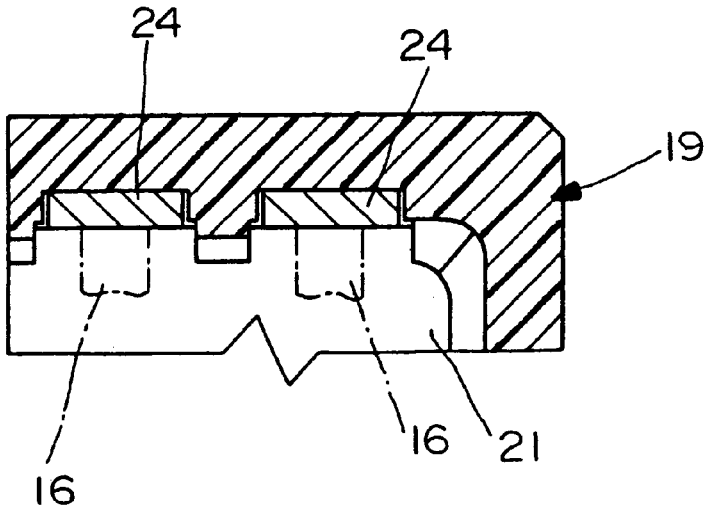
FIG. 12 is a fragmented horizontal section through a pair of the terminals of the receptacle connector in relation to a pair of the terminals of the plug connector shown in phantom.

FIG. 12 shows a pair of the contact beams 24 of terminals 20 of receptacle connector 3 in relation to a pair of the contact beams 16 of terminals 7 of plug connector 2, contact beams 16 being shown in phantom. It can be seen that the widths of contact beams 24 of the receptacle connector are significantly wider than the widths of contact beams 16 of the plug connector. In comparing the differences between the widths of the contact beams with the dimensional clearances $C_x$ and $C_y$ in FIG. 11, it can be understood that there will be constant engagement between contact beams 24 and contact beams 16 regardless of the amount of floating movement between the two connectors.

Referring back to FIG. 1, arrow 27 represents the direction of deflection of cantilevered spring beams 15 and contact beams 16 of terminals 7 of plug connector 2 when the connectors are mated. Because of the angle of contact beams 16 in particular, and in conjunction with the deflection of spring beams 15, a vertical force vector is created in the direction of arrow 28 from each contact beam 16 against contact beam 24 of terminal 20 of the receptacle connector. When the connectors are mated, the open end of receptacle portion 21 in bottom surface 192 of the receptacle connector will confront and abut against abutment wall 8*b* of plug connector 2. When all mating forces are removed from the receptacle connector, force vectors 28 from contact beams 16 and spring beams 15 of terminals 7 will cause the receptacle connector to back away from the plug connector a given distance as represented by double-arrowed space $C_z$. This occurs automatically after the connectors are forced into mating condition causing abutment between open end 19*a* and abutment wall 8*b*, and automatically upon release of the mating forces. As a result, space $C_z$ provides for floating movement between the connectors and, thereby, circuit boards 4 and 5 in the mating direction of the connectors.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A board-to-board electrical connector assembly, comprising:

a plug connector adapted for mounting on a first circuit board and including a dielectric housing having a generally rigid mating plug portion, and a plurality of conductive terminals mounted on the housing and having flexible contact portions located at said mating plug portion; and a receptacle connector adapted for mounting on a second circuit board and including a dielectric housing having a generally rigid mating receptacle portion for receiving the plug portion of the plug connector in a mating direction, and a plurality of conductive terminals mounted on the housing and having contact portions located in the receptacle portion for engaging the flexible terminals of the plug connector, said receptacle portion being larger than said plug portion in "x" and "y" directions transverse to said mating direction to provide sufficient clearance between the receptacle portion and the plug portion to provide floating movement between the connectors and, thereby, the circuit boards in said "x" and "y" directions, an open end of said receptacle portion being spaced from an abutment wall of the housing of the plug connector when the connectors are in mated positions to provide floating movement between the connectors and, thereby, the circuit boards in said mating direction and, at least one of the terminals of the plug connector including a cantilevered spring beam extending generally in the mating direction of the plug connector toward the receptacle connector and a contact beam extending obliquely from a distal end of the cantilevered spring beam back over the spring beam, the contact beam extending at an angle to said mating direction such that a force vector from the contact beam against a terminal of the receptacle connector opposite the mating direction automatically causes the open end of said receptacle portion to be spaced from the abutment wall of the plug connector.

2. An electrical connector assembly, comprising:

a plug connector having a dielectric housing including a mating plug portion, and a plug terminal mounted on the housing with a flexible spring beam extending to a flexible contact portion located at said plug portion;

a receptacle connector having a mating receptacle portion for receiving the plug portion of the plug connector in a mating direction, and a receptacle terminal mounted on the housing with a contact portion for engaging the flexible contact portion of the plug terminal; and said flexible spring beam and said flexible contact portion of the plug terminal being at such angles to said mating direction as to create a force vector from the plug terminal against the receptacle terminal opposite the mating direction and thereby cause the connectors to be automatically spaced from each other and provide floating movement between the connectors in said mating direction.

3. The connector assembly of claim 2 wherein said receptacle terminal is fixed on the housing of the receptacle connector.

4. The connector assembly of claim 3 wherein said plug terminal includes a cantilevered spring beam extending generally in the mating direction of the plug connector toward the receptacle connector.

5. The connector assembly of claim 4 wherein said flexible contact portion extends obliquely from a distal end of the cantilevered spring beam back over the spring beam.

* * * * *